US007976194B2

(12) United States Patent
Wilcox et al.

(10) Patent No.: US 7,976,194 B2
(45) Date of Patent: Jul. 12, 2011

(54) SEALING AND THERMAL ACCOMMODATION ARRANGEMENT IN LED PACKAGE/SECONDARY LENS STRUCTURE

(75) Inventors: Kurt S. Wilcox, Libertyville, IL (US); Steve R. Walczak, Hales Corners, WI (US); Wayne Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 39 days.

(21) Appl. No.: 11/744,807

(22) Filed: May 4, 2007

(65) Prior Publication Data

US 2008/0273325 A1 Nov. 6, 2008

(51) Int. Cl.
*F21S 8/00* (2006.01)

(52) U.S. Cl. ..... 362/268; 362/267; 362/331; 362/326; 362/319

(58) Field of Classification Search ..... 362/158, 362/645, 267, 227, 238, 800, 612, 306, 311.01, 362/311.02, 331, 268, 288, 319–320
See application file for complete search history.

(56) References Cited

U.S. PATENT DOCUMENTS

| | | | | |
|---|---|---|---|---|
| 5,066,889 | A | 11/1991 | Edwards | |
| 5,617,131 | A | 4/1997 | Murano et al. | |
| 5,848,839 | A | 12/1998 | Savage, Jr. | |
| 6,999,318 | B2 * | 2/2006 | Newby | 361/719 |
| 2004/0052077 | A1 | 3/2004 | Shih | |
| 2004/0076003 | A1 * | 4/2004 | Collura et al. | 362/234 |
| 2004/0160782 | A1 * | 8/2004 | Zimmermann et al. | 362/488 |
| 2005/0013139 | A1 * | 1/2005 | Sugihara et al. | 362/490 |
| 2007/0070618 | A1 * | 3/2007 | Talamo et al. | 362/153.1 |
| 2007/0076433 | A1 * | 4/2007 | Kinoshita et al. | 362/615 |
| 2007/0201225 | A1 * | 8/2007 | Holder et al. | 362/227 |
| 2007/0274084 | A1 * | 11/2007 | Kan et al. | 362/373 |
| 2008/0089060 | A1 * | 4/2008 | Kondo et al. | 362/231 |
| 2008/0198606 | A1 * | 8/2008 | Goto | 362/311 |
| 2008/0239704 | A1 * | 10/2008 | Lin | 362/101 |
| 2008/0239724 | A1 * | 10/2008 | Moriyama et al. | 362/296 |
| 2008/0266852 | A1 * | 10/2008 | Valerio et al. | 362/240 |

* cited by examiner

*Primary Examiner* — Robert May
(74) *Attorney, Agent, or Firm* — Jansson Shupe & Munger Ltd.

(57) ABSTRACT

An LED apparatus of the type having a mounting board, an LED package thereon with a primary lens, and a secondary lens member over the primary lens and establishing a light path therebetween, includes a resilient member against the secondary lens member in position other than in the light path, the resilient member yieldingly constraining the secondary lens member and accommodating secondary lens member movement caused by primary lens thermal expansion during operation.

21 Claims, 2 Drawing Sheets

SEALING AND THERMAL ACCOMMODATION ARRANGEMENT IN LED PACKAGE/SECONDARY LENS STRUCTURE

FIELD OF THE INVENTION

The invention relates generally to the field of LED lighting systems and, more particularly, it concerns mounting arrangements that are necessary to accommodate LED lens (es) movement and provide a weather-proof seal.

BACKGROUND OF THE INVENTION

In the field of lighting, many different types of light sources have been developed. Recently, LED light sources involving multi-LED arrays, each with a large number of LED packages, have been developed as a means of bringing the many advantages of LED lighting—LED efficiency and long life—into the general illumination field. In particular, such LED light fixtures have been developed for use in outdoor settings, including by way of example lighting for parking lots, roadways, display areas and other large areas.

LED fixtures in the prior art have certain shortcomings and disadvantages to which this invention is addressed. In particular, there is a need for an improved arrangement for operation of LED light having one lens positioned over another. Significant heat levels in such products can pose particular problems for lens-over-lens mounting and stability. One potential problem is that temperature changes may cause thermal expansion and related alignment problems.

Protection against various environmental factors is also rendered difficult for LED general illumination products which necessarily utilize a large number of LEDs—sometimes plural LED modules with each module having many LED packages thereon.

There is a need for improved LED lighting fixtures which can better serve the requirements of general-illumination lighting fixtures.

OBJECTS OF THE INVENTION

It is an object of this invention to provide LED apparatus which overcomes certain problems and shortcomings of the prior art including those referred to above.

Another object of the invention is to provide an improved LED apparatus with an improved arrangement for operation of LED light having one lens positioned over another.

Yet another object of the invention is to provide an improved LED apparatus protected against various environmental factors.

These and other objects of the invention will be apparent from the following descriptions and the drawings.

SUMMARY OF THE INVENTION

This invention is an improvement in LED apparatus of the type including a mounting board, an LED package thereon with a primary lens, and a secondary lens member over the primary lens and establishing a light path therebetween. The improved apparatus of this invention includes a resilient member against the secondary lens in position other than in the light path, the resilient member is yieldingly constraining the secondary lens and accommodating secondary lens movement caused by primary lens thermal expansion during operation.

In certain highly preferred embodiments, the LED apparatus includes a cover having an opening aligned with the light path, the cover securing the secondary lens member over the LED package.

In the most highly preferred embodiments of this invention, the resilient member is a gasket disposed between the cover and the mounting board, the gasket providing a weather-proof seal about the LED package. It is highly preferred that the gasket is made of silicone. Most preferably it is a closed-cell silicone. However, some other suitable resilient porous and non-porous materials can also be used.

It is highly preferred that the secondary lens member includes a lens portion and a flange thereabout, and the gasket includes an inner surface which faces and yieldingly abuts the flange. The gasket preferably has an aperture aligned with the light path. The aperture is sized to receive the lens portion of the secondary lens member.

In most highly preferred embodiments, the cover presses the gasket and the flange of the secondary lens member to the mounting board. The gasket is preferably between the cover and the flange of the secondary lens member. It is also preferred that the flange of the secondary lens member be against the mounting board.

In some most highly preferred embodiments of the present invention, the LED apparatus includes a plurality of spaced-apart LED packages on the mounting board, each LED package having a primary lens; a plurality of secondary lens members, each secondary lens being positioned over one primary lens establishing a light path therebetween; and the resilient member includes a plurality of apertures therein each aligned with a corresponding light path, the gasket providing a weather-proof seal about each of the LED packages.

In such highly preferred embodiments, the gasket is disposed between the secondary lenses and the cover. Each secondary lens preferably includes a lens portion and a flange thereabout, and each gasket aperture is sized to receive the lens portion of the corresponding secondary lens.

It is most highly preferred that the gasket is a unitary member.

The term "LED package" as used herein means an assembly including a base, at least one LED (sometimes referred to as "die") on the base, and a primary lens over the die. One or more, typically several, LED packages are arranged on a mounting board in forming what is referred to as an "LED module." One or more LED modules are used as the light source for various innovative lighting fixtures.

DETAILED DESCRIPTION OF PREFERRED EMBODIMENTS

Figure 1:
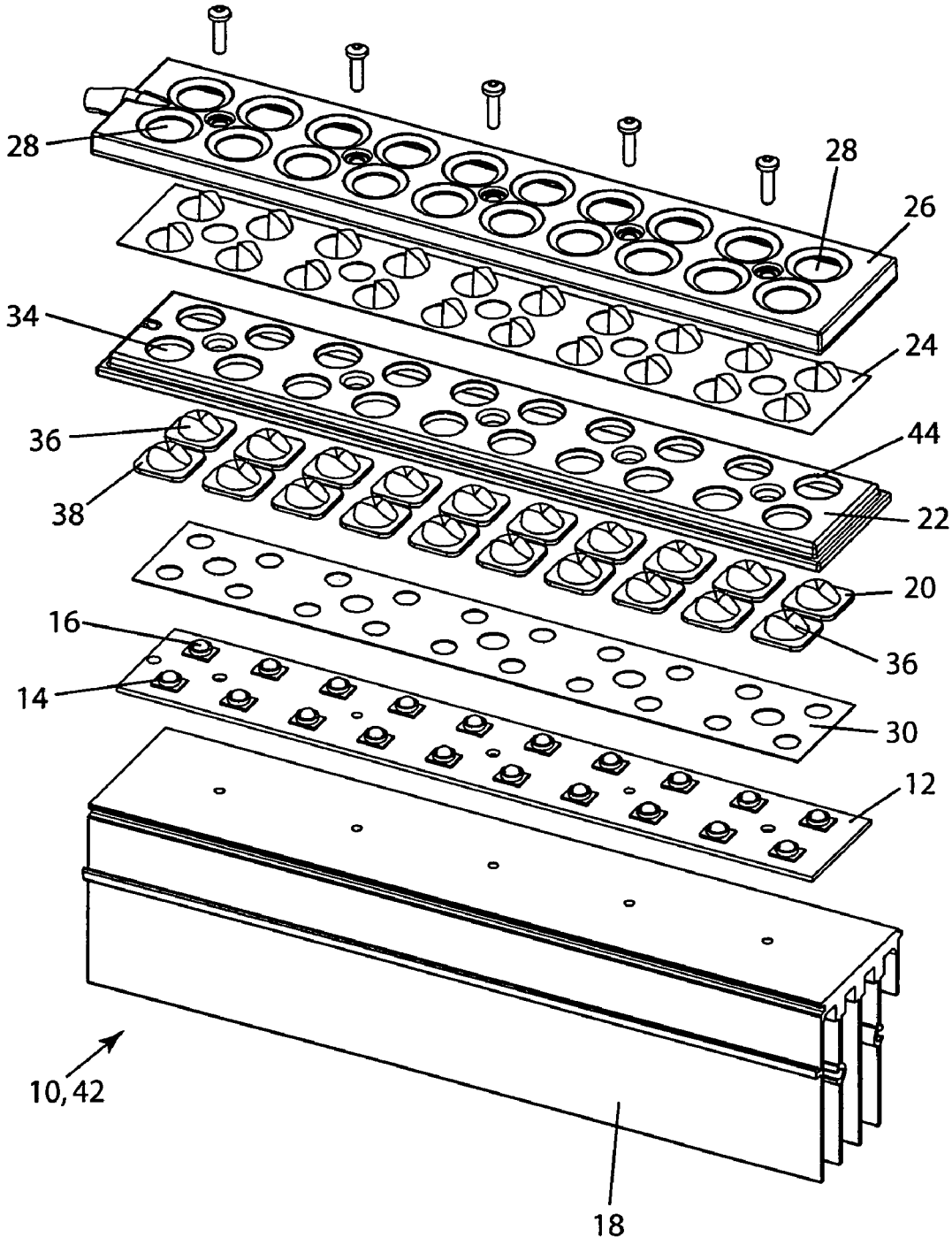
FIG. 1 is an exploded perspective view of an LED lighting apparatus.
Figure 2:
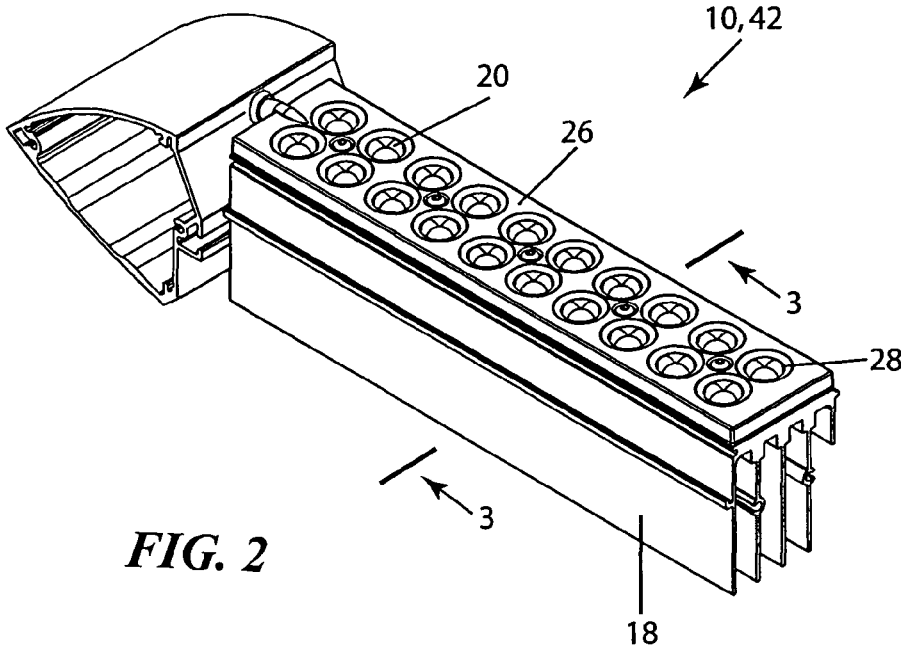
FIG. 2 is an perspective view of an LED lighting appartus of FIG. 1.
Figure 3:
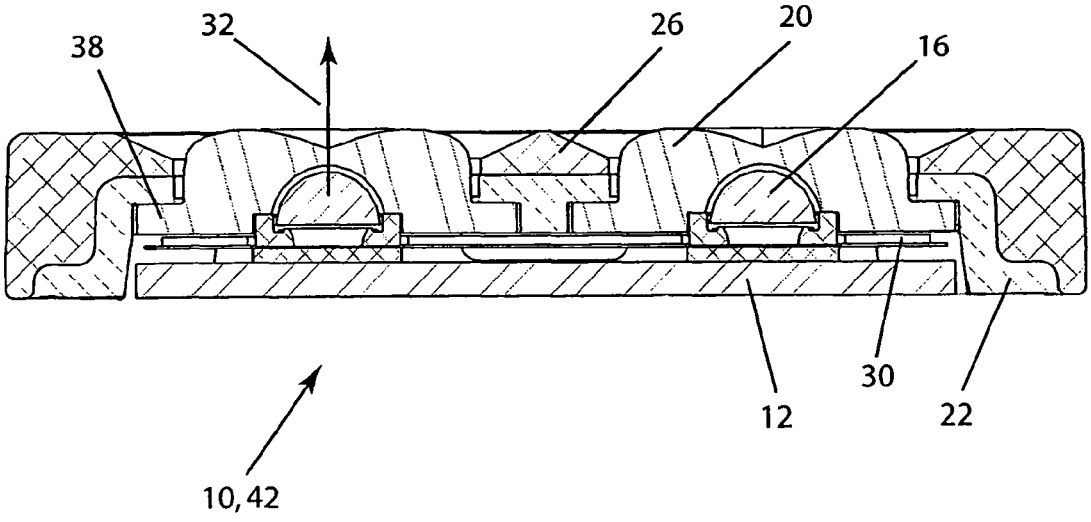
FIG. 3 is a cross-section view taken along lines 3-3 on FIG. 2.

FIGS. 1-3 illustrate an LED apparatus 10 which includes a mounting board 12, LED package 14 thereon with a primary lens 16, and a secondary lens member 20 over primary lens 16 and establishing light path 32 therebetween. Mounting board 12 is connected to a heat sink 18 as shown in FIG. 1. One or more, preferably several, LED packages 14 are arranged on a mounting board 12 to form what is referred to as an LED module 42 as illustrated in FIG. 1. One or more LED modules 42 are used as the light source for various innovative lighting fixtures. The improved LED apparatus includes a resilient member 22 against secondary lens member 20 in position other than in light path 32, resilient member 22 is yieldingly constraining secondary lens member 20 and accommodating secondary lens member 20 movement caused by primary lens 16 thermal expansion during operation.

As shown in FIG. 1, resilient member 22, in the form of a gasket layer, is positioned over mounting board 12 and LED package 14. Gasket 22 has a plurality of gasket apertures 34. A plurality of secondary lens members 20 are positioned over primary lenses 16. Preferably, the resilient member 22 is made from closed-cell silicone which is soft but solid silicone that is not porous. Resilient member 22 may also be made from any non-porous material which may be tailored for gasket use.

Secondary lens 20 includes a lens portion 36 which is substantially transparent and a flange 38 portion thereabout. Lens portions 36 is adjacent to flange portion 38 as illustrated in FIG. 1. Flange portion 38 is planar and has outer and inner surfaces. Resilient member 22 includes an inner surface 44 which faces and yieldingly abuts flange 38.

Secondary lens 20, as illustrated in FIGS. 1 and 2, is in close proximity to primary lens 16 and at least partially abuts primary lens 16. Preferably, a separate and discrete secondary lens members 20 are each provided over each LED package 14 and primary lens 16 as seen in FIG. 2. However, persons skilled in the art will appreciate that plural secondary lenses 20 can be formed together as a single part.

FIGS. 1 and 2 illustrate that cover 26 secures resilient member 22 with respect to secondary lens 20, primary lens 16 and LED package 14. Cover 26 has an opening 28 aligned with the light path 32 as shown in FIGS. 1 and 2. Resilient member 22 is sandwiched between cover 26 and flange 38 of secondary lens 20, causing outer surface of the flange portion 38 to abut the facing resilient member 22 inner surface 44. This action forms a sandwich-like structure in which cover 26 urges resilient member 22 against flange portion 38 as illustrated in FIG. 2.

Thermal expansion of primary lens 16 results in abutment of lenses and displacement of secondary lens 20. Resilient member 22 permits the displacement while holding secondary lens 20 in place over primary lens 16.

In certain embodiments a shield member 24, in the form of a layer, is positioned over the resilient member layer 22 as illustrated in FIG. 1.

Yet another embodiment of LED apparatus 10 includes a metal layer 30, preferably of an aluminum. Layer 30 is positioned preferably immediately over the LED packages and includes a plurality of openings each sized to receive the primary lens, the layer 30 is sandwiched between mounting board 12 and secondary lens 20, as seen in FIG. 1.

LED apparatus 10 can include only one LED package 14 on a mounting board 12 with primary lens 16, a corresponding secondary lens member 20 and a resilient Member layer 22 against the secondary lens member 20.

In some forms of such highly preferred embodiments with the plurality of LED packages on the mounting board, it is preferred to use a Flame Resistant 4 ("FR4") board formed by a conductor layer and insulator layers. The conductor layer may be made of any suitable conductive material, preferably copper or aluminum. It is most highly preferred that such mounting board include, for each LED package thereon, a plurality of channels ("thermal vias") extending through the mounting board at positions beneath the package, such channels having therein conductive material and/or an opening to facilitate transfer of heat through the board. The thermal vias provide an isolated thermal path for each LED package.

In the forms of the present invention using the FR4 mounting board with thermal vias, it is most highly preferred that each LED package is constructed to have its cathode terminal electrically neutral from the thermal path. Thus, avoiding shortage of other LED packages on the board.

A wide variety of materials are available for the various parts discussed and illustrated herein. While the principles of this apparatus have been described in connection with specific embodiments, it should be understood clearly that these descriptions are made only by way of example and are not intended to limit the scope of the invention.

The invention claimed is:

1. In an LED apparatus including a mounting board, an LED device thereon with a primary lens defining a light-emission axis, and a secondary lens member axially aligned over and at least partially abutting the primary lens and establishing a light path therebetween, the secondary lens member including a lens portion and a flange thereabout, the improvement comprising:

a cover having an opening aligned with the light path and securing the secondary lens member over the LED device, the secondary lens member being axially movable in response to abutment of lenses due to primary-lens thermal expansion during operation; and a resilient gasket member between the cover and the flange, the cover pressing the gasket and the flange of the secondary lens member toward the mounting board, the resilient gasket member being axially compressible permitting secondary-lens-member axial movement to maintain lens alignment and stability of the LED apparatus.

2. The LED apparatus of claim 1 wherein the resilient member provides a weather-proof seal about the LED device while accommodating axial movement of the secondary lens member.

3. The LED apparatus of claim 2 wherein the gasket is made of silicone.

4. The LED apparatus of claim 2 wherein:

the gasket includes an inner surface which faces and yieldingly abuts the flange.

5. The LED apparatus of claim 4 wherein the gasket has an aperture aligned with the light path, the gasket aperture being sized to receive the lens portion.

6. In an LED apparatus including (a) a mounting board, (b) a plurality of spaced-apart LED devices thereon, each LED device having a primary lens defining a light-emission axis, and (c) a plurality of secondary lens members each axially aligned over and at least partially abutting a respective primary lens and establishing a light path therebetween, each secondary lens member including a lens portion and a flange thereabout, the improvement comprising:

a cover having openings aligned with a corresponding light path and securing each secondary lens member over the respective LED device, the secondary lens members being axially movable in response to abutment of lenses due to primary-lens thermal expansion during operation;

a resilient gasket member between the cover and the flange, the cover pressing the gasket and the flange of each secondary lens member toward the mounting board, the resilient gasket member being axially compressible while permitting secondary-lens-member axial movement to maintain lens alignment and stability of the LED apparatus.

7. The LED apparatus of claim 6 wherein the resilient member provides a weather-proof seal about each of the LED devices while accommodating axial movement of the secondary lens members.

8. The LED apparatus of claim 7 wherein:

each gasket has an aperture sized to receive the lens portion of the corresponding secondary lens member.

9. The LED apparatus of claim 7 wherein the resilient member is a unitary member.

10. The LED apparatus of claim 6 wherein the secondary lens members are separate and discrete secondary lens members each provided over a respective one of the primary lenses.

11. In an LED apparatus including a mounting board, an LED device thereon defining a light-emission axis, and a lens member axially aligned over the LED device establishing a light path therebetween, the lens member including a lens portion and a flange thereabout, the improvement comprising:

a cover having an opening aligned with the light path and securing the lens member over the LED device, the lens member being axially movable in response to LED-device thermal expansion during operation; and a resilient gasket member between the cover and the flange, the cover pressing the gasket and the flange of the lens member toward the mounting board, the resilient gasket member being axially compressible permitting lens-member axial movement to maintain lens alignment and stability of the LED apparatus.

12. The LED apparatus of claim 11 wherein the resilient member provides a weather-proof seal about the LED device while accommodating axial movement of the lens member.

13. The LED apparatus of claim 12 wherein the resilient member is a gasket made of silicone.

14. The LED apparatus of claim 13 wherein:

the gasket includes an inner surface which faces and yieldingly abuts the flange.

15. The LED apparatus of claim 14 wherein the gasket has an aperture aligned with the light path, the gasket aperture being sized to receive the lens portion.

16. In an LED apparatus including a mounting board, a plurality of spaced-apart LED devices thereon each defining a light-emission axis, and a plurality of lens members each axially aligned over a respective LED device and establishing a light path therebetween, each lens member including a lens portion and a flange thereabout, the improvement comprising:

a cover having openings aligned with a corresponding light path and securing each secondary lens member over the respective LED device, the lens members being axially movable in response to LED-device thermal expansion during operation; and a resilient gasket member between the cover and the flanges, the cover pressing the gasket and the flange of each lens member toward the mounting board, the resilient gasket member being axially compressible permitting lens-member axial movement to maintain lens alignment and stability of the LED apparatus.

17. The LED apparatus of claim 16 wherein the resilient member provides a weather-proof seal about each of the LED devices while accommodating axial movement of the lens members.

18. The LED apparatus of claim 17 wherein:

each gasket has an aperture sized to receive the lens portion of the corresponding lens member.

19. The LED apparatus of claim 17 wherein the resilient member is a unitary member.

20. The LED apparatus of claim 16 wherein the lens members are separate and discrete lens members each provided over a respective one of the LED devices.

21. In an LED apparatus including a mounting board, an LED device thereon defining a light-emission axis, and a lens member axially aligned over the LED device establishing a light path therebetween, the improvement comprising:

the lens member being yieldingly constrained over the LED device and being axially movable with respect thereto due to LED device thermal expansion during operation, the lens member including a lens portion and a flange thereabout;

a cover having an opening aligned with the light path and securing the lens member over the LED device; and a resilient gasket between the cover and the flange such that the cover presses the gasket and the flange toward the mounting board, the gasket including an inner surface which faces and yieldingly abuts the flange and an aperture aligned with the light path and sized to receive the lens portion therethrough, the gasket being axially compressible to yieldingly constrain the lens member, thereby to provide a weather-proof seal about the LED device while accommodating axial movement of the lens member.

* * * * *

UNITED STATES PATENT AND TRADEMARK OFFICE

CERTIFICATE OF CORRECTION

PATENT NO. : 7,976,194 B2
APPLICATION NO. : 11/744807
DATED : July 12, 2011
INVENTOR(S) : Wilcox et al.

It is certified that error appears in the above-identified patent and that said Letters Patent is hereby corrected as shown below:

Title page, Item (54) In the title, after the word "LED", delete "PACKAGE/SECONDARY LENS STRUCTURE" and insert --DEVICES--.

In column 2, delete the paragraph at lines 26 through 32, and replace with the following paragraph:

--In some highly preferred embodiments of the present invention, the LED apparatus includes a plurality of spaced-apart LED packages on the mounting board, each LED package having a primary lens and a plurality of secondary lens members each of which is positioned over one primary lens establishing a light path therebetween, and the resilient member includes a plurality of apertures therein each aligned with a corresponding light path, the resilient member providing a weather-proof seal about each of the LED packages.--.

In column 2, line 52, after the words "view of", delete "an" and insert --the--.

In column 3, line 13, after the word "soft", delete "but" and insert --,--.

In column 3, line 26, before the word "separate", delete "a".

In column 3, line 49, before the word "aluminum", delete "an".

In column 3, line 51, after the word "receive", delete "the".

In column 3, line 52, after the words "primary lens", delete ", the layer" and insert --16. Layer--.

In column 4, line 6, delete ". Thus," and insert --, thus--.

Signed and Sealed this
Seventh Day of February, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,976,194 B2
APPLICATION NO. : 11/744807
DATED : July 12, 2011
INVENTOR(S) : Wilcox et al.

It is certified that error appears in the above-identified patent and that said Letters Patent is hereby corrected as shown below:

Title page, Item (54) and at Column 1, lines 3 and 4, In the title, after the word "LED", delete "PACKAGE/SECONDARY LENS STRUCTURE" and insert --DEVICES--.

In column 2, delete the paragraph at lines 26 through 32, and replace with the following paragraph:

--In some highly preferred embodiments of the present invention, the LED apparatus includes a plurality of spaced-apart LED packages on the mounting board, each LED package having a primary lens and a plurality of secondary lens members each of which is positioned over one primary lens establishing a light path therebetween, and the resilient member includes a plurality of apertures therein each aligned with a corresponding light path, the resilient member providing a weather-proof seal about each of the LED packages.--.

In column 2, line 52, after the words "view of", delete "an" and insert --the--.

In column 3, line 13, after the word "soft", delete "but" and insert --,--.

In column 3, line 26, before the word "separate", delete "a".

In column 3, line 49, before the word "aluminum", delete "an".

In column 3, line 51, after the word "receive", delete "the".

In column 3, line 52, after the words "primary lens", delete ", the layer" and insert --16. Layer--.

In column 4, line 6, delete ". Thus," and insert --, thus--.

This certificate supersedes the Certificate of Correction issued February 7, 2012.

Signed and Sealed this
Twenty-eighth Day of February, 2012

David J. Kappos

David J. Kappos
*Director of the United States Patent and Trademark Office*